United States Patent [19]

Kirkland

[11] Patent Number: 4,704,826

[45] Date of Patent: Nov. 10, 1987

[54] SPIN-BLAST TOOL

[76] Inventor: Wyatt Kirkland, 1536 Chanticleer Ave., Santa Cruz, Calif. 95062

[21] Appl. No.: 277,813

[22] Filed: Jun. 26, 1981

[51] Int. Cl.[4] ..... B24C 3/06

[52] U.S. Cl. ..... 51/411; 51/439; 239/252; 239/256; 188/296

[58] Field of Search ..... 51/411, 439; 239/225, 239/252, 256, DIG. 13, 178; 188/290, 296; 15/3.5; 308/187

[56] References Cited

U.S. PATENT DOCUMENTS

| | | | |
|---|---|---|---|
| 1,090,530 | 3/1914 | Grube | 308/187 |
| 2,465,154 | 3/1949 | Harstick | 188/290 |
| 3,029,028 | 4/1962 | Skerritt | 239/256 |
| 3,137,974 | 6/1964 | Kirkland | 51/411 |
| 3,292,863 | 12/1966 | Nelson | 239/256 |
| 3,902,276 | 9/1975 | Jarvis | 51/411 |
| 4,314,427 | 2/1982 | Stoltz | 51/411 |

FOREIGN PATENT DOCUMENTS

| | | | |
|---|---|---|---|
| 0025425 | 3/1981 | Fed. Rep. of Germany | 239/252 |
| 792640 | of 1936 | France | 188/90 |
| 685591 | 1/1953 | United Kingdom | 188/290 |

*Primary Examiner*—Frederick R. Schmidt
*Assistant Examiner*—Robert A. Rose

[57] ABSTRACT

An improved spin-blast tool having a stationary handle with coaxial inner and outer pipes. The inner pipe, connected to a jet head, rotates at high speed relative to the stationary outer pipe. A plenum defined by the outer surface of the inner pipe and the inner surface of the outer pipe, as well as by opposed lateral sealed bearings, supporting the inner pipe within the outer pipe, define a plenum which is filled with a viscous fluid. The inner pipe supports radially outwardly extending vanes which work against the viscous fluid, thereby slowing rotation and preventing damage to the inner shaft and the jet head. An axial groove along the outer peripheral surface of the inner pipe leaks small amounts of the viscous fluid beneath at least one of the sealed bearings for the purpose of lubricating a stationary shaft seal which comes in contact with rotating members.

2 Claims, 6 Drawing Figures

SPIN-BLAST TOOL

DESCRIPTION

1. Technical Field

The invention relates to a tool for cleaning the interior of pipes and more particularly to an improved handle construction for such a tool.

2. Background Art

In U.S. Pat. No 3,137,974 W. S. Kirkland disclosed a spin-blast tool of a type having a hollow tubular handle connected at one end to a blast slurry supply pipe and at the opposite end to a spinning jet head. The blast slurry supply pipe carries an abrasive material such as sand in a sand-air mixture at approximately 110 pounds of pressure. The air pressure forces rotation of the jet head at approximately 1000 revolutions per minute. Under this pressure, the jet head would rotate even faster, causing severe vibration and ultimately destruction of the tool. To slow the rotation of the jet head a centrifugal brake is provided, slowing the speed of rotation. Excessive rotational speed indicates a worn or defective brake lining or a brake control component. Typically, brake linings must be replaced after approximately four hours use.

Another of the problems encountered and solved in the prior art spin-blast tool mentioned above, was protecting the seals at opposite ends of the handle. Protection was provided by annular leather dust seals, with annular sleeves pushing the leather seals against bearing seals. Like the brake linings, the leather dust seals must be replaced from time to time.

An object of the invention is to devise an improved spin-blast tool wherein handle components, especially the brake mechanism and bearing seals, last longer, but do not diminish performance of the tool.

DISCLOSURE OF INVENTION

The above object has been achieved in an improved spin-blast tool having a handle which features a hydraulic drag brake. The improved handle has coaxial inner and outer pipes, with the inner pipe supported by opposed bearings within the outer pipe. The bearings form a plenum between the two pipes which is filled approximately two-thirds full with viscous fluid. Vanes extending radially outwardly from the pipe resist rotation of the inner pipe as viscous fluid within the plenum seeks to flow around the vanes.

A protective seal at one end of the handle consists of a shaft seal surrounding the inner pipe, with a lateral side contacting the inner rotating race of a sealed bearing as well as a shaft seal retainer on the opposite lateral side. The improved seal construction features the inner pipe notched at its outer surface in a direction parallel to the pipe axis so that a small leak is provided from the viscous fluid plenum, underneath the bearing to the interface between the bearing and the shaft seal. By lubricating the surface of the shaft seal facing the rotating bearing race, there is little wear on the shaft seal due to rotation of the inner bearing race, yet a tight dust seal is provided.

The advantage of the present invention is that prior art brake linings are eliminated. Similarly, leather dust seals are eliminated. Both the brake linings and the leather seals are replaced by members which have far longer lifetimes, eliminating maintenance time and costs.

BEST MODE FOR CARRYING OUT THE INVENTION

Figure 1:
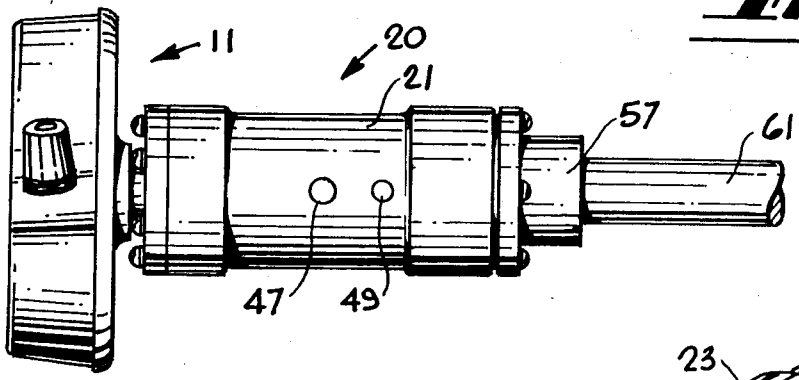
FIG. 1 is a side view of the present invention, connected to a blast slurry supply pipe.

In FIG. 1 it will be seen that the major assemblies of the spin-blast tool include the jet head 11 and the tubular handle 20. A blast slurry supply pipe 61 is connected to the rear flange 57. Handle 20 and slurry supply pipe 61 do not rotate. Of the major external components, only jet head 11 rotates. The handle 20 is intended to be mounted axially within a pipe to be cleaned. Mounting is by means of outwardly extending arms as shown in FIG. 9 of the previously mentioned U.S. Pat. No. 3,137,974. Other axial mounting means may be used, such as outwardly extending skids, evenly spaced about the handle periphery. A pipe to be cleaned is pushed past the skids so that the spinning jet nozzles blast the inside diameter of a pipe to be cleaned with slurry material.

Figure 2:
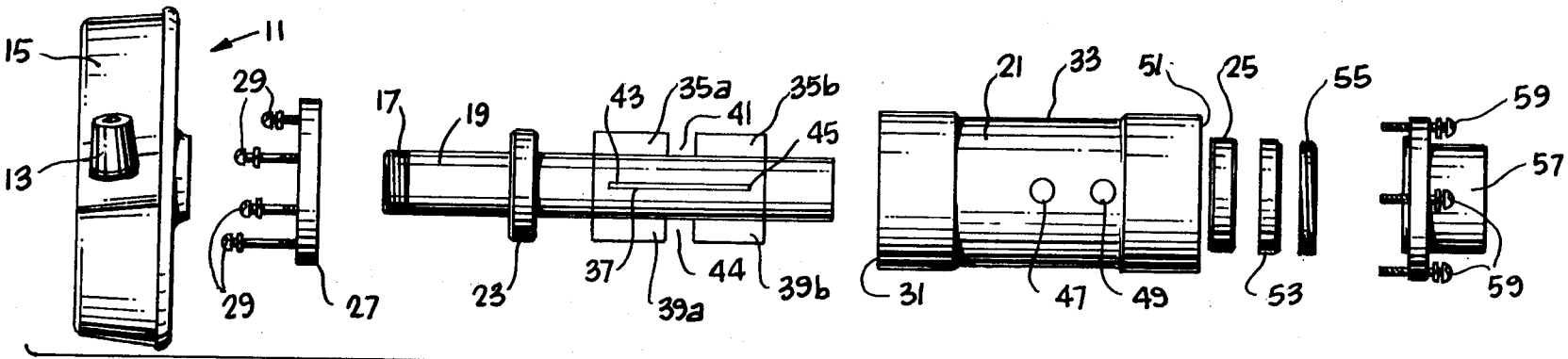
FIG. 2 is an exploded side view of the improved spin-blast tool shown in FIG. 1.
Figure 3:
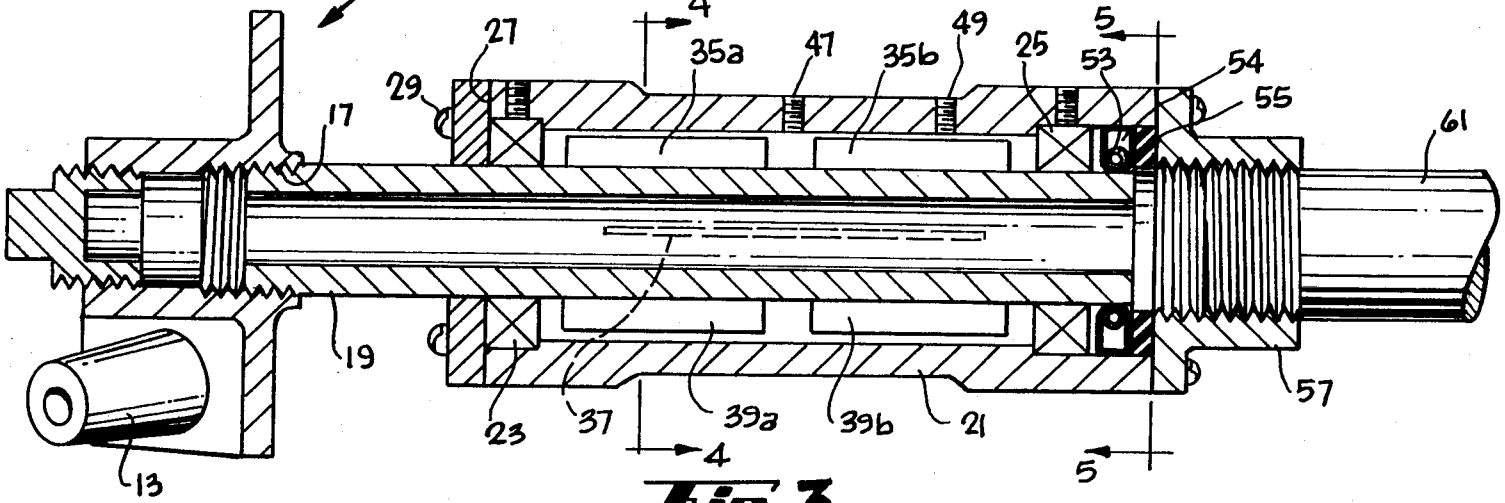
FIG. 3 is a side sectional view of the improved spin-blast tool shown in FIG. 1.

With reference to FIGS. 2 and 3 the improved spin-blast tool of the present invention is shown in side view. A spinning jet head 11 is of the same type as described in the previously mentioned U.S. Pat. No. 3,137,974, incorporated by reference herein. The jet head has plural nozzles, including nozzle 13 in a hollow body 15. Blast slurry ejected through nozzle 13 causes rotation of the jet head in a direction opposite to the blast slurry stream. Usually two nozzles are provided, on opposite sides of the jet head, spraying blast slurry material in opposite directions, complementing each other in causing rotation of the jet head 11. The hollow chamber 15 is screwed to thread 17 of rotating inner pipe 19. The jet head is fixed relative to pipe 19 so that spinning of the jet head causes spinning of inner pipe 19. Inner pipe 19 is coaxial with and slightly longer than outer pipe 21. Typically, the inner pipe may have an inside radius of approximately ½ inch and an outer radius of ¾ inch. The outer pipe may have an inside radius of approximately 1¼ inches and an outside radius of approximately 1½ inches. Inner pipe 19 is held in place by front bearing 23 and rear bearing 25. Each of these bearings is a sealed bearing which is press fit in place. Each of the bearings has an inner race and an outer race, with ball bearings between races. The inner race is fixed to inner pipe 19 while the outer race is fixed to outer pipe 21. Front bearing 23 is capped by a cover plate 27 having screws 29 which connect the cover plate to forward end 31 of pipe 21. It will be noted that forward end 31 has a slightly larger diameter than central portion 33 of pipe 21.

Extending radially outwardly from inner pipe 19 is a plurality of vanes **35*a*, 35*b*, 37, 39*a* and 39*b*. These vanes are perpendicular to the surface of pipe 19 and typically are thin steel plates which are welded to the pipe surface. The radial extent of the vanes is such that there is no contact with outer pipe 21, yet the vanes approach the inside diameter of pipe 21. Vanes 35*a* and 35*b* lie in the same plane and are the same size. Each of the vanes has a lateral edge adjacent, but not contacting bearing races. A gap is provided between the vanes 35***a* and 35*b*, as well as 39*a* and 39*b*, for hydraulic fluid motion between the vanes. Midway between vanes 35*a*, 35*b* and vanes 39*a*, 39*b*, about the inner pipe outer circumference, the vane 37 is located. Unlike vanes 35*a* and 35*b* or 39*a* and 39*b*, vane 37 is unitary, having no central fluid path. Instead, a fluid path is provided at opposite ends 43 and 45 of the vane.

The plenum between inner and outer pipes and between forward and rear bearings is filled with a viscous hydraulic fluid, such as S.A.E. 90 motor oil. The vanes 35*a*, 35*b*, 37, 39*a* and 39*b*, as well as a vane diametrically opposite vane 37, i.e., 180° away, work against the viscous fluid, which tends to remain in place, flowing laterally around the vanes, as the vanes rotate. The viscous fluid resists vane motion. The viscous fluid has a tortuous lateral flow path which may be viewed as starting with gap 41, thence proceeding around vane 37 to the regions 43 and 45, thence through gap 44 and then to other gaps similar to the gaps near the regions 43 and 45, except on the opposite side of the pipe and then back to gap 41. Another smaller gap is provided in the space between the most radial outward distance from the vane and the inside diameter of the outer pipe. Outer pipe 21 will be seen to have an oil fill hole 47 and an air outlet hole 49. Once the plenum is supplied with the viscous fluid to the extent of approximately two-third full, the holes 47 and 49 are capped with screws.

At the rearward end of outer pipe 21, adjacent to the rear bearing 25 a shaft seal 53 is disposed about the inner pipe 19 at a location 51, approximately flush with the rear end of the outer pipe 21. This shaft seal has a lateral side contacting the rotating inner race of rear bearing 25, yet the shaft seal does not rotate. Rotation is prevented by feeding a slight amount of oil along a notch beneath the inner race of bearing 25 so that the shaft seal is lubricated. The shaft seal 53 is held in place by retainer 55 which is press fit into end 51 of outer pipe 21. A rear flange 57 is connected to pipe 21 by means of screws 59 which are seated in the enlarged rearward periphery of pipe 21.

In FIG. 3, it is seen that the flange 57 has internal threads which connect to mating threads on the outside of blast slurry supply pipe 61. The inside of the stationary blast slurry supply pipe communicates with rotating inner pipe 19. It will be seen that shaft seal 53 is of the well-known type having an annular spring 54 which clamps the seal to inner pipe 19.

Figure 4:
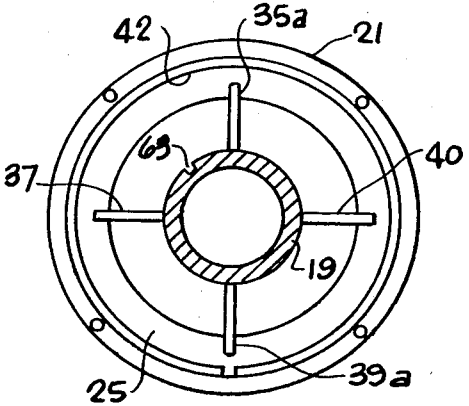
FIG. 4 is a view taken along the lines 4—4 in FIG. 3.

With reference to FIG. 4, the axial relationship of inner pipe relative to outer pipe 21 may be seen. The vanes 35*a*, 37, 39*a* and 40 may be seen to have the same radial extent. The vanes approach, but do not touch the inside periphery 42 of outer pipe 21. A lengthwise axial slot 63 may be seen. This slot allows hydraulic fluid in the plenum between inner and outer pipes to escape beneath the forward sealed bearing to lubricate shaft seal 53.

Figure 5:
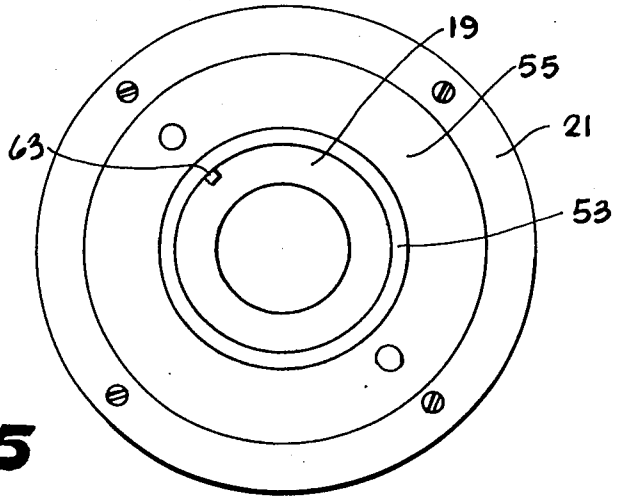
FIG. 5 is a view taken along lines 5—5 in FIG. 3.

The slot may be seen more clearly in the end view of FIG. 5. The slot is only approximately 1 mil deep in the outside periphery of inner pipe 19, extending beneath the sealed bearing so that a trickle of hydraulic fluid reaches the interface between shaft seal 53 and the inner race of sealed bearing 25 in FIG. 3. Returning to FIG. 5, the shaft seal 53 is sufficiently lubricated so that it remains stationary, contacting the stationary retainer 55, as well as the rotating inner bearing race, not visible as a flgure. The retainer 55 is press fit into an end of outer pipe 21 and held in place by a set screw, not shown, extending from the outer periphery of outer pipe 21 into the circumferential periphery of retainer 55.

Figure 6:
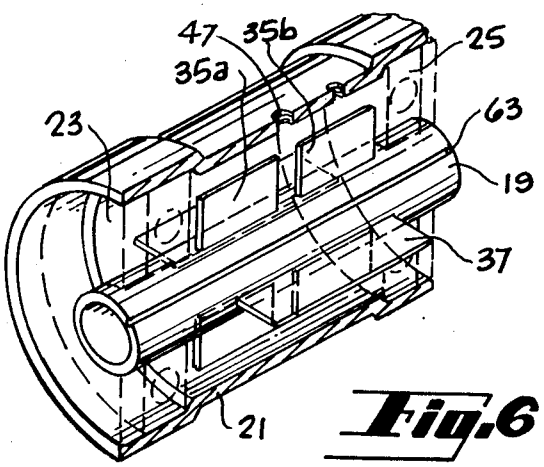
FIG. 6 is a perspective cutaway view of the improved handle of the present invention.

Again in FIG. 6, the slot 63 may be seen extending beneath bearing 53. The figure also shows radial vanes 35*a*, 35*b* and 37, projecting from inner pipe 19. The inner pipe is maintained in coaxial relation with respect to the outer pipe by the sealed bearings indicated by dashed lines 23 and 25. The radially extending vanes within the hydraulic fluid provide a brake for an improved spin-blast tool such that wear due to abrasion is minimized. The same hydraulic fluid which is used to provide the braking effect is used to lubricate the shaft seal so that protective dust covers, which needed replacement in a prior art, can be eliminated.

I claim:

1. In a pipe spin-blast tool having a tubular handle with inflow and outflow ends and a spinning jet head connected to the outflow end, the improved handle construction comprising, tubular, coaxial inner and outer pipes having opposite inflow and outflow ends with sealed annular bearings coaxially mounted at said opposite ends, sealing the annular space therebetween forming a plenum, the inside of the inner pipe remaining clear for transmitting a sand-air blast, the bearings having inner and outer races with the outer races being fixed relative to the outer pipe and the inner races being fixed relative to the inner pipe so that the inner pipe may rotate while the outer pipe is stationary, said plenum containing a viscous fluid, a plurality of vanes radially extending outwardly from the inner pipe into said viscous fluid forming a tortuous path for motion of said viscous fluid whereby rotation of the inner pipe is slowed by resistance of said viscous fluid to motion of said vanes therein, said vanes having a lengthwise alignment parallel to the axis of the pipes, flange means for connecting a sand-air blast supply pipe to the inside of the inner pipe at the inflow end thereof for activating a spinning jet head connected to the outflow end, wherein said flange means is spaced from the inner bearing race by a shaft seal, said inner pipe defining a notch in the outer peripheral surface beneath said inner bearing race for slowly leaking viscous fluid from said plenum to lubricate said shaft seal.

2. In a pipe spin-blast tool having a tubular handle with inflow and outflow ends and a spinning jet head connected to the outflow end, the improved handle construction comprising, tubular, coaxial inner and outer pipes having opposite inflow and outflow ends with sealed annular bearings coaxially mounted at said opposite ends, sealing the annular space therebetween forming a plenum, the inside of the inner pipe remaining clear for transmitting a sand-air blast, the bearings having inner and outer races with the outer races being fixed relative to the outer pipe and the inner races being fixed relative to the inner pipe so that the inner pipe may rotate while the outer pipe is stationary, said plenum containing a viscous fluid, a plurality of vanes radially extending outwardly from the inner pipe into plenum containing said viscous fluid forming a tortuous path for motion of said viscous fluid whereby rotation of the inner pipe is slowed by resistance of said viscous fluid to motion of said vanes therein, said vanes having a lengthwise alignment parallel to the axis of the pipes, flange means for connecting a sand-air blast supply pipe to the inside of the inner pipe at the inflow end thereof for activating a spinning jet head connected to the outflow end, and a shaft seal between the inner bearing race and a flange means, said seal being lubricated by said viscous fluid leaking from the plenum through a notch in the outer peripheral surface of the inner pipe extending beneath the inner bearing race.

* * * * *